US010531188B2

(12) United States Patent
Uchida

(10) Patent No.: US 10,531,188 B2
(45) Date of Patent: Jan. 7, 2020

(54) SOUND COLLECTING DEVICE AND SOUND COLLECTING METHOD

(71) Applicant: OLYMPUS CORPORATION, Hachioji-shi, Tokyo (JP)

(72) Inventor: Junichi Uchida, Hachioji (JP)

(73) Assignee: OLYMPUS CORPORATION, Tokyo (JP)

( * ) Notice: Subject to any disclaimer, the term of this patent is extended or adjusted under 35 U.S.C. 154(b) by 0 days.

(21) Appl. No.: 16/027,411

(22) Filed: Jul. 5, 2018

(65) Prior Publication Data

US 2019/0020949 A1 Jan. 17, 2019

(30) Foreign Application Priority Data

Jul. 11, 2017 (JP) ..... 2017-135637

(51) Int. Cl.

| | |
|---|---|
| ***H04R 1/40*** | (2006.01) |
| ***H04R 5/027*** | (2006.01) |
| ***H04R 5/04*** | (2006.01) |
| ***H04R 3/00*** | (2006.01) |
| ***H04S 7/00*** | (2006.01) |

(52) U.S. Cl.

CPC ..... *H04R 1/406* (2013.01); *H04R 3/005* (2013.01); *H04R 5/027* (2013.01); *H04R 5/04* (2013.01); *H04R 2410/05* (2013.01); *H04S 7/30* (2013.01); *H04S 2400/15* (2013.01)

(58) Field of Classification Search

None

See application file for complete search history.

(56) References Cited

U.S. PATENT DOCUMENTS

| | | | | |
|---|---|---|---|---|
| 4,334,740 | A * | 6/1982 | Wray | G03B 31/00 352/11 |
| 4,984,087 | A * | 1/1991 | Fujimura | H04N 5/232 348/222.1 |
| 5,978,490 | A * | 11/1999 | Choi | H04R 3/005 381/107 |
| 6,507,659 | B1 * | 1/2003 | Iredale | H04R 3/005 381/111 |
| 2009/0129621 | A1 * | 5/2009 | Izuchi | H04M 1/03 381/365 |
| 2013/0142342 | A1 * | 6/2013 | Del Galdo | H04R 3/005 381/56 |
| 2013/0258813 | A1 * | 10/2013 | Herre | H04R 1/406 367/135 |
| 2014/0334639 | A1 * | 11/2014 | Gotoh | H04R 3/005 381/92 |
| 2014/0350926 | A1 * | 11/2014 | Schuster | G10L 15/00 704/233 |

(Continued)

FOREIGN PATENT DOCUMENTS

| | | |
|---|---|---|
| JP | 2012-129854 A | 7/2012 |
| JP | 2013-110629 A | 6/2013 |

*Primary Examiner* — Qin Zhu

(74) *Attorney, Agent, or Firm* — Volpe and Koenig, P.C.

(57) ABSTRACT

A sound collecting device, comprising stereo microphones that are arranged apart in a direction intersecting obliquely with respect to a direction that is vertical to a direction connecting the user and an subject, and arranged at different distances in the direction that joins the user and the subject, and a processor for directivity control that adjust directivity of speech signals from the stereo microphones.

19 Claims, 11 Drawing Sheets

(56) References Cited

U.S. PATENT DOCUMENTS

| | | | | |
|---|---|---|---|---|
| 2015/0181338 | A1* | 6/2015 | Hosoi | H04R 5/033 381/309 |
| 2015/0189436 | A1* | 7/2015 | Kelloniemi | H04S 7/30 381/98 |
| 2017/0303043 | A1* | 10/2017 | Young | H04R 5/027 |
| 2018/0233129 | A1* | 8/2018 | Bakish | G10L 21/0272 |
| 2018/0262838 | A1* | 9/2018 | Ishizaki | H04R 5/027 |
| 2018/0302738 | A1* | 10/2018 | Di Censo | H04S 7/306 |

* cited by examiner

SOUND COLLECTING DEVICE AND SOUND COLLECTING METHOD

CROSS-REFERENCE TO RELATED APPLICATIONS

Benefit is claimed, under 35 U.S.C. § 119, to the filing date of prior Japanese Patent Application No. 2017-135637 filed on Jul. 11, 2017. This application is expressly incorporated herein by reference. The scope of the present invention is not limited to any requirements of the specific embodiments described in the application.

BACKGROUND OF THE INVENTION

1. Field of the Invention

The present invention relates to a sound collecting device and sound collecting method that, when collecting sound using a stereo microphone, remove noise with a simple structure, and easily control sound collection range for gathering of speech.

2. Description of the Related Art

A speech gathering device is known wherein, since listening is difficult if noise is contained, when collecting external sounds a first microphone for external sound collection and a second microphone for machine sound collection are provided, and noise can be reduced by cancelling noise in a speech signal from the first microphone with a machine sound canceling signal that has been generated with a speech signal from the second microphone (refer to Japanese patent laid-open No. 2013-110629 (hereafter referred to as "patent publication 1")). A speech gathering device is also known wherein, at the time of movie shooting, in the case of collecting sound with a microphone, directivity of sound collection is controlled so as to face in the direction of a sound source (refer to Japanese patent laid-open No. 2012-129854 (hereafter referred to as "patent publication 2")).

With the sound collection device of patent publication 1, if external sound is collected using a stereo microphone, it is necessary to have two microphones for machine noise collection in addition to the two microphones for stereo recording, and so the number of microphones used is increased. Also, with the sound collecting device of patent publication 2, there is a description only that directivity is simply switched over if direction of a sound is set, but there is no description of controlling directional range in response to sound collection state.

SUMMARY OF THE INVENTION

The present invention provides a sound collecting device and sound collecting method that are capable of controlling directivity in response to state of a subject of sound collection.

A sound collecting device of a first aspect of the present invention comprises stereo microphones that are arranged apart in a direction intersecting obliquely with respect to a direction that is vertical to a direction connecting the user and a subject, and that are arranged at different distances in the direction connecting the user and the subject, and a processor for directivity control that adjust directivity of speech signals from the stereo microphones.

A sound collecting method of a second aspect of the present invention is a sound collecting method for a sound collecting device having stereo microphones that are arranged apart in a direction intersecting obliquely with respect to a direction that is vertical to a direction connecting the user and a subject, and in a direction that is slightly oblique to that direction, and are arranged at different distances in the direction that joins the user and the subject, and comprises: adjusting directivity of sound collection in response to phase difference of two speech signal from the stereo microphones.

A sound collecting device of a third aspect of the present invention comprises a stereo microphone having a first microphone and a second microphone that convert speech from a user or subject into a speech signal, the first microphone and the second microphone being arranged at positions that are different distances from the user or the subject, a phase difference detection circuit that detects phase difference between two speech signals that have been converted by the first microphone and the second microphone, and a processor for directivity control that adjusts directivity of speech signals based on the phase difference that has been detected by the phase difference detection circuit.

DETAILED DESCRIPTION OF THE PREFERRED EMBODIMENTS

A sound collecting device of preferred embodiments of the present invention can be applied to various devices, and first an example applied to a camera will be described in the following, as one embodiment. It should be noted that this camera may be not only a compact camera or single lens reflex camera that are ordinarily used as cameras, but also a camera that is built in to a smartphone or tablet PC etc. The present invention may also be used in a system that is a combination of a camera having an imaging section and a smartphone having a control section.

This camera has an imaging section, with a subject image being converted to image data by this imaging section, and the subject image being subjected to live view display on a display section based on this converted image data. A photographer determines composition and photo opportunity by looking at the live view display. If a release button is operated, image data of a still image is stored in a storage medium, and if a movie button is operated image data of a movie is stored in the storage medium.

Also, two microphones are arranged in this camera, in a direction that is oblique to a direction that is vertical to the optical axis direction of a photographing lens (refer to FIG. 3 and FIG. 5, which will described later). However if the two microphones are projected onto a YZ axial surface, positions of the two microphones are displaced in a Z axis direction (optical axis direction of the photographing lens) (referred to FIG. 5A and FIG. 5B). As a result, speech signals from the two microphones have a phase difference in a longitudinal direction of the camera (optical axis direction of the photographing lens), in addition to the normal stereo microphone characteristics. Using this phase difference it is possible to change directivity of sound collection (directivity range), and it is possible to remove noise using speech from a specified direction.

Figure 1:
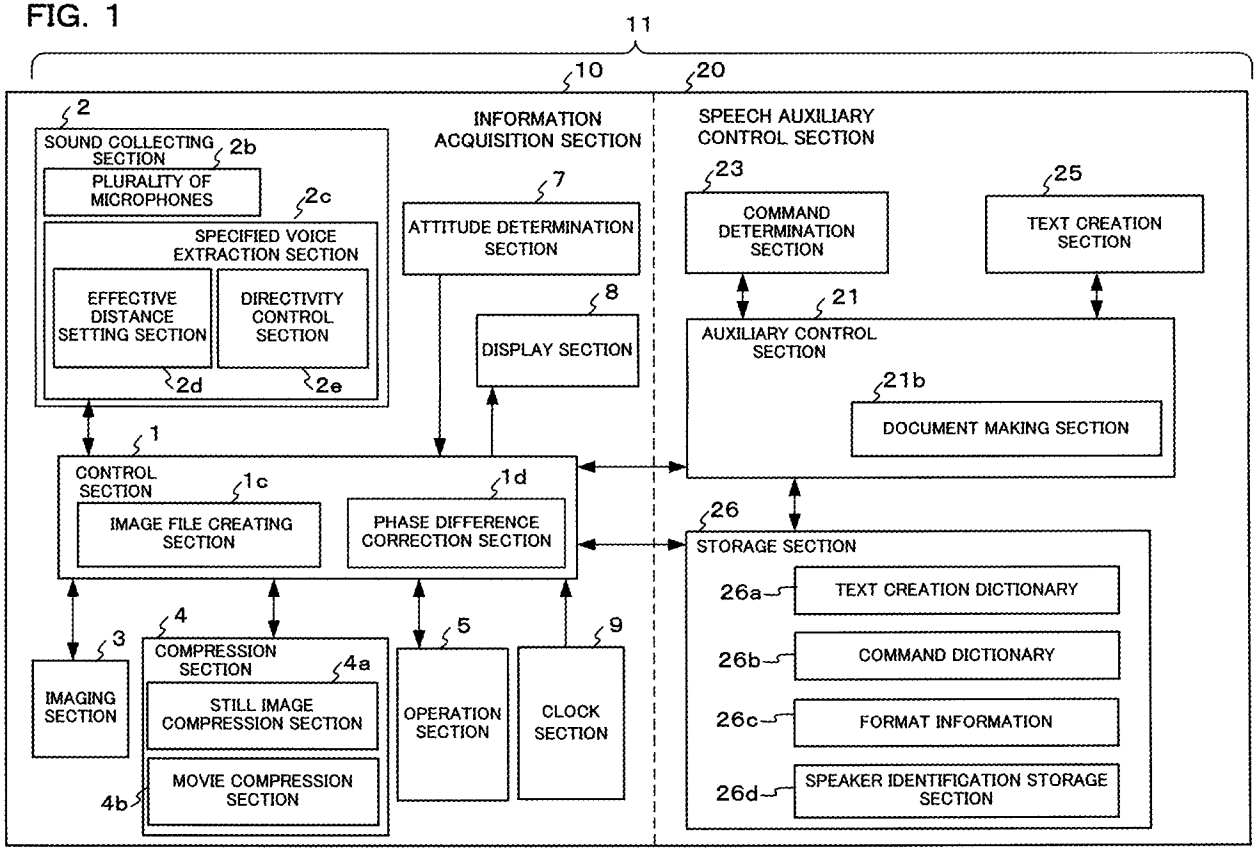
FIG. 1 is a block diagram mainly showing the electrical structure of a sound collecting device of one embodiment of the present invention.

FIG. 1 is a block diagram showing the electrical structure of a camera 11 of one embodiment of the present invention. This camera 11 is comprised of an information acquisition section 10 and a speech auxiliary control section 20. The camera 11 may have an integrated structure so as to have both of the information acquisition section 10 and the speech auxiliary control section 20, or may be a camera that has only the information acquisition section 10, with functions of the speech auxiliary control section 20 being assumed at a smartphone side. In the case of the latter, communication may be performed between the information acquisition section 10 and the speech auxiliary control section 20 in a wireless or wired manner.

A sound collection section 2 is provided with a plurality of microphones 2*b* and a specified speech extraction section 2*c*. The plurality of microphones 2*b* are constituted by two or more microphones, and each microphone converts speech to a speech signal. A speech signal that has been converted is converted to digital data, and is further subjected to various processing. Sound collection characteristics of the microphones will be described later using FIG. 2.

Also, the plurality of microphones 2*b* function as stereo microphones arranged separately in a direction that is oblique to a direction that is vertical to the direction connecting the user and the subject, and arranged at different distances from the user in a direction that links the user and the subject. Arrangement of the respective microphones of the plurality of microphones 2*b* will be described later using FIG. 3 and FIG. 5. Here, the user is a person who uses the sound collecting device, such as a camera, and the subject is a subject of sound collection. The plurality of microphones 2*b* function as a stereo microphone having first and second microphones that convert speech from the user or the subject to speech signals. The first and second microphones are arranged at positions that are a different distance from the user or the subject.

The specified speech extraction section 2*c* is a processor (or speech extraction circuit) for extracting speech, and has an effective distance setting section 2*d* and a directivity control section 2*e*. As will be described later, a phase difference correction section 1*d* is provided within the control section 1, and detects phase difference between speech signals of two microphones. The effective distance setting section 2*d* sets an effective distance for a sound source to be collected based on phase difference that has been detected by the phase difference correction section 1*d*. A mechanism for driving a zoom is provided within the imaging section 3, and an effective distance setting function is performed by detecting information on focal length of the zoom. Sensitivity of a microphone becomes higher in accordance with telescoping of a zoom lens from a wide angle end.

Also, the directivity control section 2*e* has a directivity control circuit, and controls sound collection range, namely directivity, based on phase difference of speech signals. The directivity control section 2*e* functions as a processor for directivity control (directivity control section) that adjusts directivity of speech signals from the stereo microphone. Detailed structure of the directivity control circuit will be described later using FIG. 6.

Figure 8A:
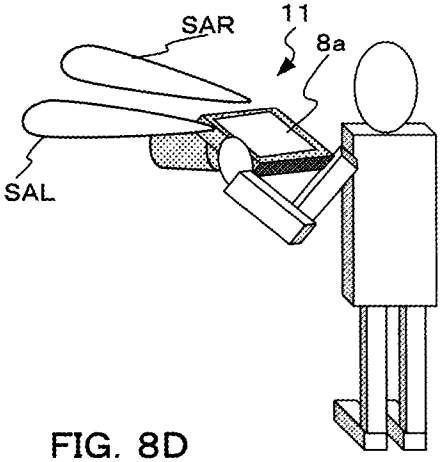
FIG. 8A to FIG. 8E are drawings showing usage states of the sound collecting device of the one embodiment of the present invention.
Figure 8B:
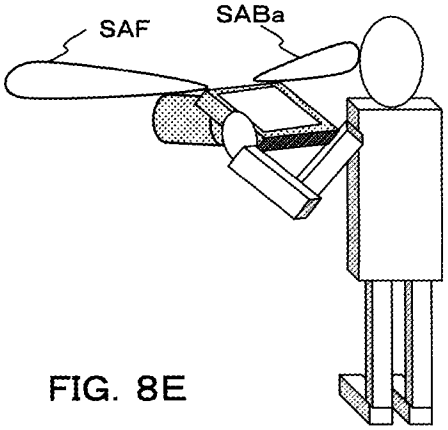
Figure 9:
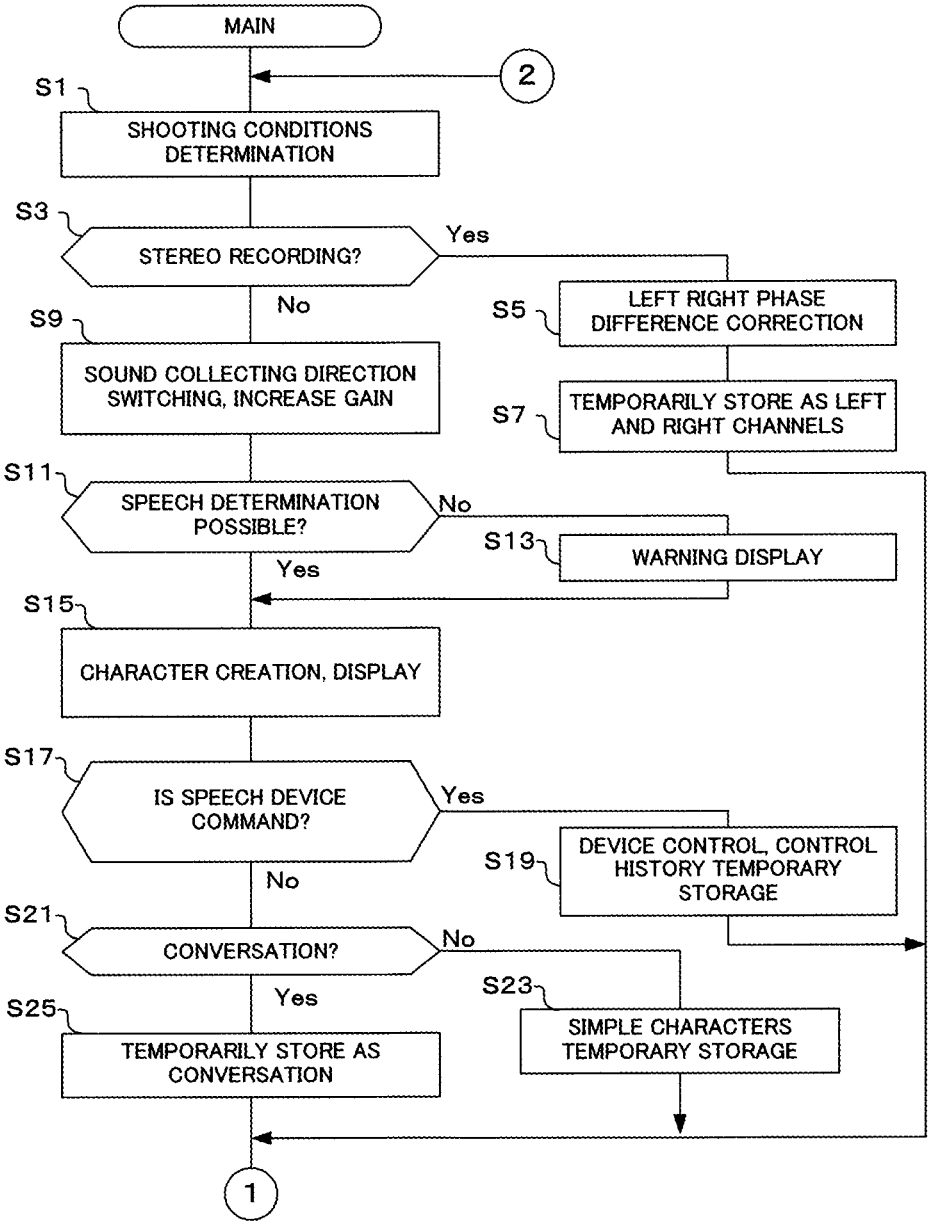
FIG. 9 is a flowchart showing operation of the sound collecting device of one embodiment of the present invention.

The directivity control section 2*e* functions as a processor (directivity control section) that switches to a first sound collecting characteristic for collecting environment sounds and a second sound collecting characteristic for mainly collecting sound from an interviewer, depending on a mode (refer, for example, to first sound collecting characteristics SAR and SAL in FIG. 8A, second sound collecting characteristic SAF in FIG. 8B, and S3, and S5 to S9 in FIG. 9). The first sound collecting characteristic is directivity towards a subject in front (refer, for example, to FIG. 8A). The first sound collecting characteristic is stereo sound collection in a wide range (refer, for example, to FIG. 8A). The directivity control section 2*e* functions as a processor (directivity control section) that adjusts directivity of speech from in front and from behind (refer, for example, to FIG. 8B and S9 in FIG. 9).

Figure 8C:
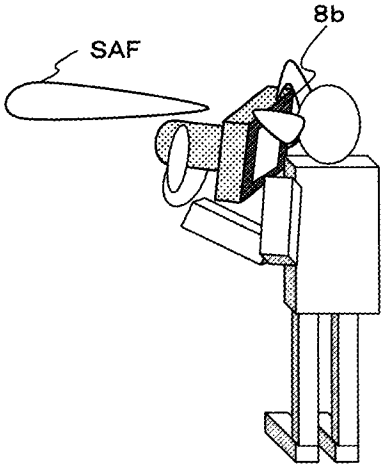

The directivity control section 2*e* functions as a processor (directivity control section) that is capable of a third sound collecting characteristic for collecting sound in a narrow range in front (refer, for example, to FIG. 8C and S9 in FIG. 9). The directivity control section 2*e* functions as a process (directivity control section) that determines whether or not speech of a user that has been acquired by the stereo microphones is a command for device control, and if the result of determination is that the speech is a command, controls the sound collecting device in accordance with the command (refer, for example, to S17 and S19 in FIG. 9, etc.).

The directivity control section 2*e* also functions as a processor for directivity control that adjusts directivity of speech signals based on phase difference that has been detected by the phase difference detection circuit (refer, for example, to FIG. 8A to FIG. 8E, S5 and S9 in FIG. 9, etc.). The directivity control processor (directivity control section), in the event that stereo recording is performed using stereo microphones, performs left and right phase difference correction for speech signals from the first and second microphones based on phase difference that has been detected by the phase difference detection circuit (refer, for example, to S3 Yes, S5 and S7 in FIG. 9). In a case where stereo recording using stereo microphones is not performed, the directivity control processor (directivity control section) performs switching of sound collecting direction or performs sound collecting range adjustment for from the first and second microphones (refer, for example, to S3 No and S9 in FIG. 9).

The imaging section 3 has an image sensor, and besides the image sensor has various operation members and circuits etc. such as an optical lens, imaging circuit, lens drive mechanism, lens drive circuit, aperture, aperture drive mechanism, aperture drive circuit, shutter, shutter drive mechanism, shutter drive circuit, etc. The lens drive mechanism, aperture and shutter etc. may be appropriately omitted. The imaging section subjects an image that has been formed by the optical lens to photoelectric conversion using the image sensor, and outputs an image signal (image data) that has been acquired in this way to the control section 1.

A compression section 4 has a still image compression section 4*a* and a movie compression section 4*b*. The still image compression section 4*a* has a compression circuit, subjects image data of a still image that has been input from the control section 1 to compression processing, and outputs the result of compression to the control section 1. The movie compression section 4*b* has a compression circuit, subjects movie image data that has been input from the control section 1 to compression processing, and outputs the result of compression to the control section 1. The control section 1 outputs these image data that have been compressed to a storage section 26, and the storage section 26 stores these image data. It should be noted that as well as compression processing, the compression section 4 may perform expansion processing of image data that has been compressed, and a display section 8 may perform display using this image data that has been expanded.

The operation section 5 is an interface, has various camera operation members, such as a release button, movie button, mode setting dial, cross-shaped button etc., and may have a touch panel or the like that is capable of detecting touched states of the display section 8. Further, the operation section 5 also has a switch etc. for designating whether sound collection using the sound collection section 2 is stereo recording or monaural recording. The operation section 5 detects operating states of various operation members and output results of detection to the control section 1. In a case where a smartphone or the like fulfills the functions of the information acquisition section 10, operation members of a device such as the smartphone fulfill the function as the operation section 5. The operation section 5 functions as an interface (mode setting section) that sets a mode.

A timer section 9 has a clocking function and a calendar function, and outputs clocked results and calendar information to the control section 1. These items of information are used when storing speech and image information etc.

An attitude determination section 7 has sensors for attitude detection, such as Gyro, angular acceleration sensor etc., and determines attitude of the camera and outputs determination results to the control section 1.

The display section 8 has a display, and performs various display on this display, such as live view display based on image data that has been acquired by the imaging section 3, and playback display and menu screen display based on image data that has been stored in the storage section 26. As a display there are a rear surface display arranged on the rear surface of the camera (refer to FIG. 5 and FIG. 8) and an electronic viewfinder (EVF) that is viewed through an eyepiece (refer to FIG. 5), etc., and it is also possible to have only one of these.

The control section 1 has a processor, and this processor is constituted by an ASIC (Application Specific Integrated Circuit) that includes a CPU (Central Processing Unit), a memory that stores programs, and peripheral circuits (hardware circuits). The CPU controls each section within the information acquisition section 10 and the speech auxiliary control section 20 in accordance with programs that have been stored in the memory. It should be noted that control within the speech auxiliary control section 20 is performed by means of an auxiliary control section 21.

There are an image file generating section 1*c* and a phase difference correction section 1*d* within the control section 1. With this embodiment the image file generating section 1*c* is implemented by the CPU using software, and the phase difference correction section 1*d* is implemented using peripheral circuits. It should be noted that the image file generating section 1*c* may also be implemented by peripheral circuits, and the phase difference correction section 1*d* may also be implemented in software. Also, peripheral circuits may also implement some or all of the functions of the specified speech extraction section 2*c*, compression section 4 and attitude determination section 7.

The image file generating section 1*c* generates an image file that is made up of image data that has been acquired by the imaging section 3, voice data that has been acquired by the sound collection section 2, and other information. With this embodiment there are three types of image file, namely an image file for a still image, a movie image file A and a movie image file B, and detailed content of the image files will be described later using FIG. 2.

The phase difference correction section 1*d* detects a phase difference between speech signals that have been acquired by the two microphones of microphone 2*d*, and corrects the phase difference. The phase difference correction section 1*d* has a phase difference detection circuit and a phase difference correction circuit. The phase difference detection circuit detects a phase difference between two signals as shown, for example, in FIG. 7A and FIG. 7B. The phase difference correction circuit performs correction for canceling the phase difference of the signals. The way in which the phase difference correction is performed in this phase difference correction section 1*d* will be described later using FIG. 7. The phase difference correction section 1*d* functions as a phase difference detection circuit that detects phase difference between two speech signals that have been converted by the first microphone and the second microphone.

The speech auxiliary control section 20 has an auxiliary control section 21, command determination section 23, text generating section 25 and storage section 26.

The command determination section 23 has a processor, and determines content that the user has instructed to the device by speaking. Specifically, when speech is acquired using the plurality of microphones 2*b*, only speech of the user is extracted by adjusting sound collecting direction (sound collecting range) and gain. A command dictionary 26*b* within the storage section 26 is then referenced on the basis of the voice data that has been extracted, and a command that the user has issued to the device is determined. For example, in a case where the device is a camera, if the user says "zooming", the user's voice is converted to text, and if that text appears in the command dictionary 26*b* it is recognized as a command.

The text generating section 25 has a processor for text data conversion, and converts voice data to text based on speech that has been acquired by the plurality of microphones 2*b*. This conversion is performed while referencing a text generating dictionary 26*a* that is stored in the storage section 26.

The auxiliary control section 21 has a processor, and this processor is constituted by an ASIC (Application Specific Integrated Circuit) that includes a CPU (Central Processing Unit), a memory that stores programs, and peripheral circuits (hardware circuits). The CPU controls each section within the speech auxiliary control section 20 in accordance with programs that have been stored in the memory and instructions from the control section 1.

A document making section 21*b* creates documents using text that has been converted in the text generating section 25, and format information 26*c* that has been stored in the storage section 26. While the document making section 21*b* may be implemented by peripheral circuits within the auxiliary control section 21, it is implemented in software using the CPU.

The storage section 26 is memory, and has electrically rewritable volatile memory and electrically rewritable non-volatile memory. This non-volatile memory stores image files that have been generated by the image file generating section 1*c* within the control section 1. There are also the text generating dictionary 26*a*, command dictionary 26*b*, format information 26*c* and speaker recognition storage section 26*d* in the non-volatile memory.

The text generating dictionary 26*a* is a dictionary that is used when converting voice data to text in the text generating section 25, as was described previously. Text corresponding to voice data patterns is stored in this dictionary (refer to S15 in FIG. 9). Using this dictionary it becomes easy to make speech into text in accordance with technical terms, abbreviations, language features, etc. that are finely attuned to the situation in which the device is used, and it is also possible to improve precision at the time of converting to text strings such as for speech which is not listed in the dictionary that would be taken as inappropriate text etc.

As was described previously, the command dictionary 26*b* is a dictionary that is used when determining, in the command determination section 23, whether or not a command is contained within voice data. Commands corresponding to voice data patterns are stored in this dictionary (refer to S17 in FIG. 9). If this type of dictionary is customized, commands that also correspond to complex control become possible. Making operational commands into text becomes easy, and for items that do not appear in this dictionary it is possible to determine that they are erroneous operations etc., and it is possible to improve precision at the time of control.

The format information 26*c* stores information for documentation when creating documents in the document making section 21*b*. Since patterns for when creating typical documents are stored, it is possible for the document making section 21*b* to generate a document by inserting text in accordance with these patterns.

The speaker recognition storage section 26*d* stores information for identifying a speaker. Depending on the speaker there will be features in voice data patterns etc., and so these features are stored, and when creating an image file the speaker is specified using information that is stored in this speaker recognition storage section 26*d* and a speaker name is also stored (refer to S25 in FIG. 9).

Figure 2:
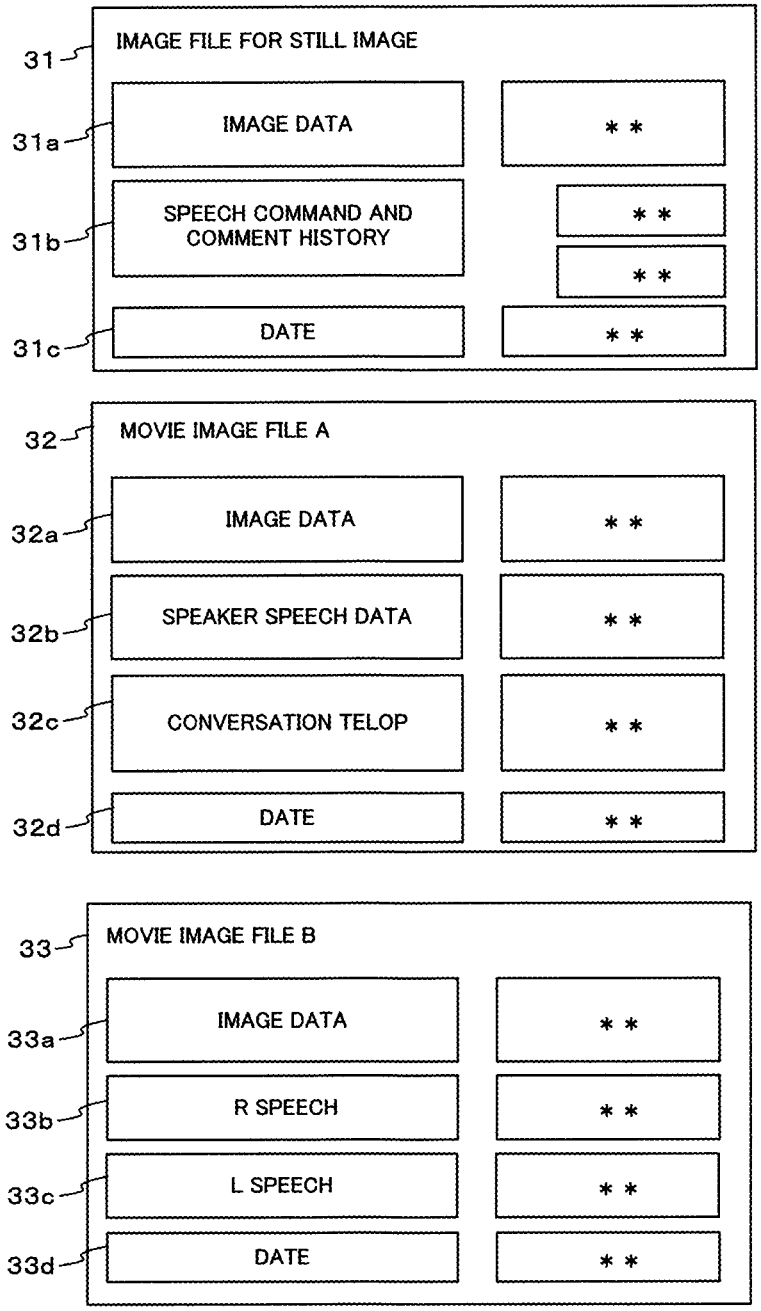
FIG. 2 is a drawing showing structure of a file stored by the sound collecting device of the one embodiment of the present invention.

Next, an image file that is generated by the image file generating section 1*c* will be described using FIG. 2. Three types of image file are created, namely an image file of a still image 31, a movie image file A 32 and a movie image file B 33, and stored in the storage section 26.

The image file of a still image 31 has regions for storing image data 31*a*, speech command and comment history 31*b*, and date 31*c*. The image file of a still image 31 is stored when still picture shooting such as in FIG. 8C, which will described later, has been performed. The image data 31*a* is image data of a still image acquired when the user has pressed the release button. The speech command and comment history 31*b* is voice data etc. that has been spoken by the user at the time of still picture shooting. The date 31*c* is time and date information for when a still image was taken, and is stored based on information from the timer section 9. It is possible to use this type of history as evidence information for various operation processes, and learning and erroneous operation prevention becomes possible with such information.

The movie image file A 32 has regions for storing image data 32*a*, conversation voice data 32*b*, conversation subtitles 32*c*, and date 32*d*. The movie image file A 32 is created when shooting a movie, such as in FIG. 8B, which will be described later. The image data 32*a* is image data of a movie that has been acquired from commencement of movie recording as a result of the user operating the movie button until completion of movie recording as a result of the movie button being operated again.

The conversation voice data 32*b* is a region for storing conversations held between a parent and a child, conversations taking place between a plurality of people, etc. as voice data. In this embodiment, it is possible to adjust directivity by detecting phase difference. In the event that a conversation is taking place, directivity is adjusted towards a person constituting a sound source, and it is possible to store clear speech.

The conversation subtitles 32*c* is a region for storing text resulting from converting conversation speech to text. The text generating section 25 can convert conversation voice data 32*b* to text data, and text data that has been converted is stored in the conversation subtitles 32*c* region. The date 32*d* is time and date information at which a movie was taken, and time and date information for commencement and completion of shooting is stored in the date 32*d* region based on information from the timer section 9.

The movie image file B 33 has regions for storing image data 33*a*, R voice data 33*b*, L voice data 33*c*, and date 33*d*. The movie image file B 33 is created when shooting a movie, such as in FIG. 8A, which will be described later. Similarly to the image data 32*a*, the image data 33*a* is image data of a movie that has been acquired from commencement of movie recording as a result of the user operating the movie button until completion of movie recording as a result of the movie button being operated again.

R speech 33*b* is a region in which voice data that has been acquired by a microphone that is arranged on the right side, among the plurality of microphones 2*b*, is stored. L speech 33*c* is a region in which voice data that has been acquired by a microphone that is arranged on the left side, among the plurality of microphones 2*b*, is stored. Stereo voice data is constituted by the R voice data and the L voice data. As shown in FIG. 3, arrangement positions of two microphones are in an optical axis direction and in a direction that is substantially orthogonal to the optical axis direction, and so a phase difference arises, and voice data that has had phase difference corrected by the phase difference correction section 1*d* is stored.

Similarly to the date 32*d*, the date 33*d* is time and date information at which a movie was taken, and is a region in which time and date information for commencement and completion of shooting is stored based on information from the timer section 9.

Next, arrangement positions of the plurality of microphones 2*b* will be described using FIG. 3. FIG. 3 shows a camera 11 provided with a sound collecting device, and a photographing lens 3*a* is arranged on a front surface of this camera 11. A right side microphone 2*b*R and a left side microphone 2*b*L are arranged inside the camera body. Center lines CR and CL of sound collecting range of the right side microphone 2*b*R and the left side microphone 2*b*L are directed towards a front surface (direction forward, from the optical axis direction (Z axis) side of the photographing lens 3*a* to respective sides at about 45 degrees) side of the camera. The plurality of microphones 2*b* shown in FIG. 3 function as a stereo microphone having two microphones, namely a first microphone (for example, the right side microphone 2*b*R) that is arranged on a first surface that is substantially orthogonal to a direction that joins the user and the subject (optical axis O, Z axis), and a second microphone (for example. the left side microphone 2*b*L) that is arranged on a second surface that is substantially orthogonal to a direction that joins the user and the subject. Also, a sound collecting direction of the stereo microphone is in a direction that joins the user and the subject.

A distance between the centerline CR and the centerline CL of the sound collection range, specifically, a distance in the x axis direction between the two microphones 2*b*R and 2*b*L, is a stereo position difference Ds. Also, a distance between a plane passing through the right side microphone 2*b*R, and a plane passing through the left side microphone 2*b*L, both planes being orthogonal to the photographing lens 3*a*, is a directivity position difference Dd.

In this way, the plurality of microphones 2*b* are respectively arranged in separate directions, namely in a direction that joins the user and the subject (direction of the optical axis O of the photographing lens 3*a*, z axis direction), and in a direction substantially orthogonal to that (X axis direction), and also arranged at different distances in a direction that joins the user and the subject (optical axis O, z axis direction). The first microphone (for example, the right side microphone 2*b*R) and the second microphone (for example, the left side microphone 2*b*L) described above have a difference in distance (Dd in the example if FIG. 3) in a direction that joins the user and a subject. In order to increase the distance difference, the first microphone (right side microphone 2*b*R) may be arranged on a grip section that projects from the front of the camera for holding the camera firmly.

Figure 4:
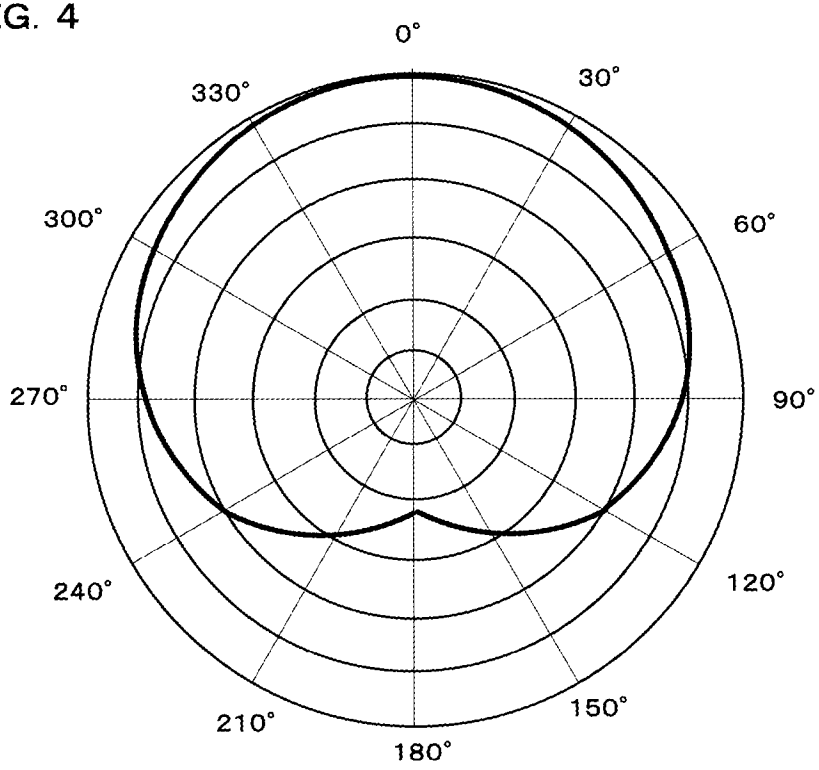
FIG. 4 is a drawing showing sound collecting range of the sound collecting device of the one embodiment of the present invention.

FIG. 4 shows directional characteristics of a unidirectional microphone that is built into a general-purpose camera. Although sensitivity drops from a rear surface direction, sound at the rear surface can not be completely removed with simple microphone performance, and so unnecessary noise is picked up.

Next, a modified example of arrangements of the plurality of microphones 2*b* will be described using FIG. 5A and FIG. 5B. With the one embodiment that was shown in FIG. 3, two microphones were arranged directed to the front of the camera (z axis direction in FIG. 3). Conversely, with the modified example shown in FIG. 5 two microphones are arranged directed upward of the camera (y axis direction in FIG. 3).

Figure 3:
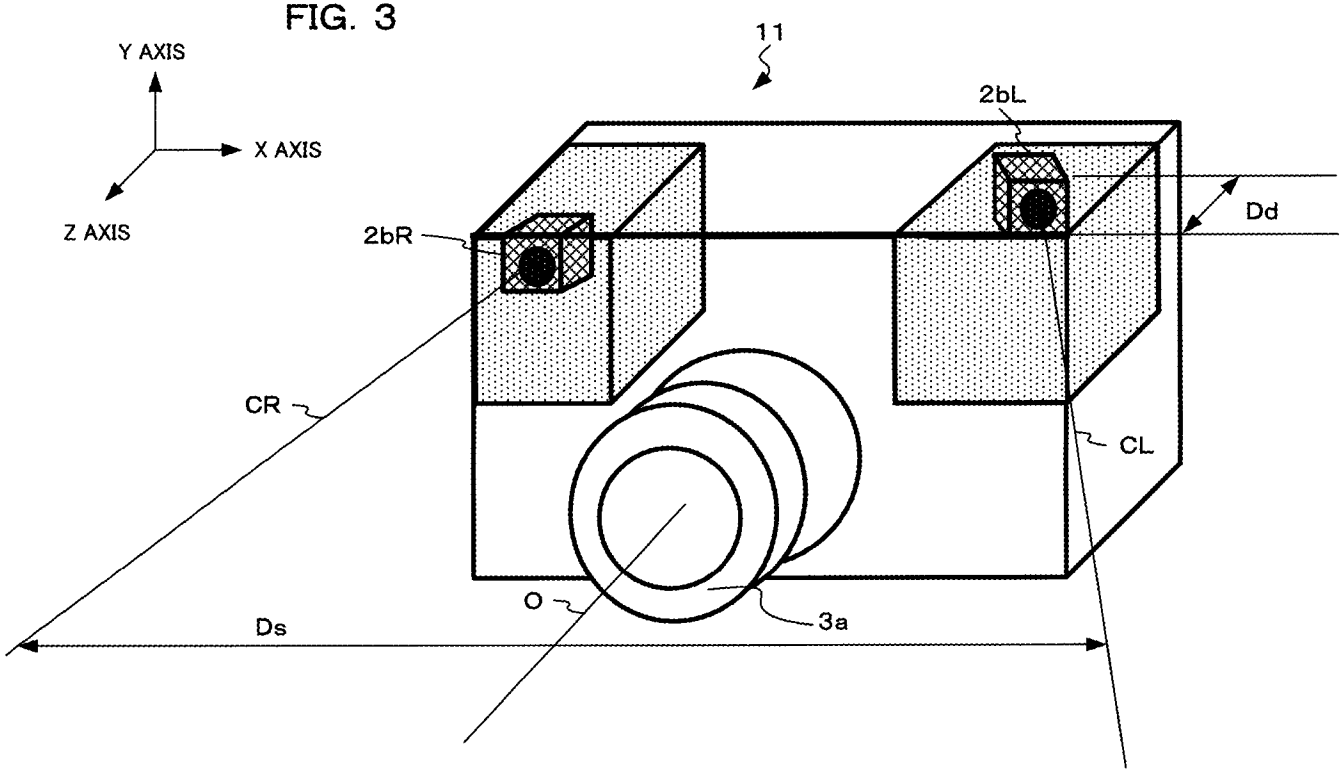
FIG. 3 is a perspective view of a digital camera that incorporates the sound collecting device of the one embodiment of the present invention.

Similarly to the camera that was shown in FIG. 3, a photographing lens 3*a* is provided on a front surface of the camera. Circuitry 50 that provides the control section 1, circuits of the sound collection section 2, circuits of the imaging section 3 etc. is arranged inside the camera.

Also, a rear surface panel 8*a* is movably arranged on the rear surface of the camera body as a display section 8. Live view display and display of various images such as playback images and menu screens based on image data that has already been stored is performed on the rear surface panel 8*a*. Also, an electronic viewfinder (EVF) 8*b* is provided on an upper rear part of the camera. On the EVF 8*b* it is possible to observe live view display and various images such as playback images and menu screens based on image data that has already been stored, through the eyepiece.

A movie button 5*b* is arranged at the rear surface side of the camera body, higher up than the EVF 8*b*. If the movie button 5*b* is operated shooting of a movie is commenced, and if the movie button 5*b* is pressed again movie shooting is completed. A release button 5*a* is provided on an upper surface of the camera body. If the release button 5*a* is operated, still picture shooting is performed.

Also, a first microphone 2*b*A and a second microphone 2*b*B, among the plurality of microphones 2*b*, are arranged on an upper surface of the camera body. The first microphone 2*b*A has a sound collecting range SAA, while the second microphone 2*b*B has a sound collecting range SBA (in FIG. 5A sound collecting ranges are not described, but are the same as the sound collection ranges of FIG. 5B). Also, the first microphone 2*b*A is held by an elastic holding section 2*b*Ae, while the second microphone 2*b*B is held by an elastic holding section 2*b*Be. The microphones being held by the elastic holding sections 2*b*Ae and 2*b*Be is in order to reduce noise of the user's finger rubbing entering the microphones 2*b*A and 2*b*B through the casing.

Figure 5B:
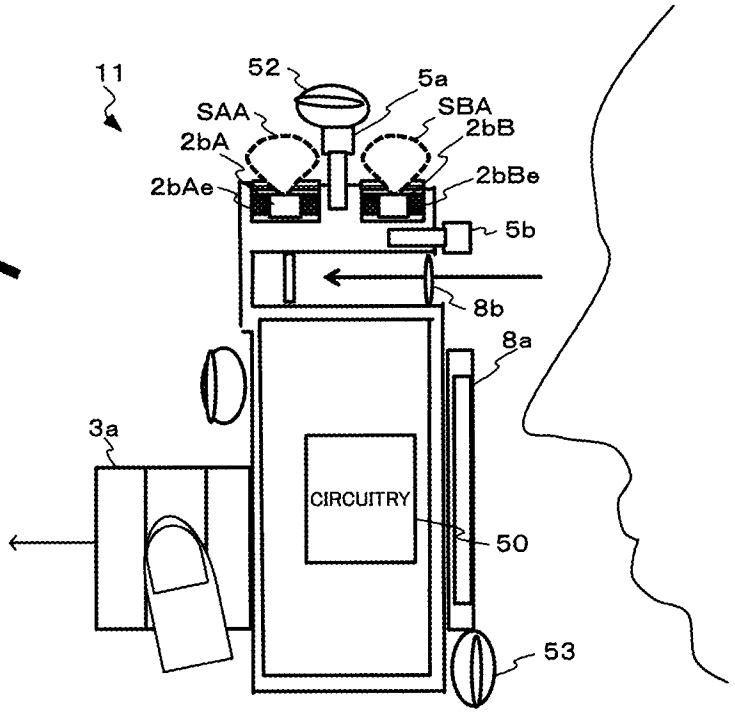
FIG. 5A and FIG. 5B are side views showing a modified example of a digital camera that incorporates the sound collecting device of the one embodiment of the present invention.
Figure 5A:
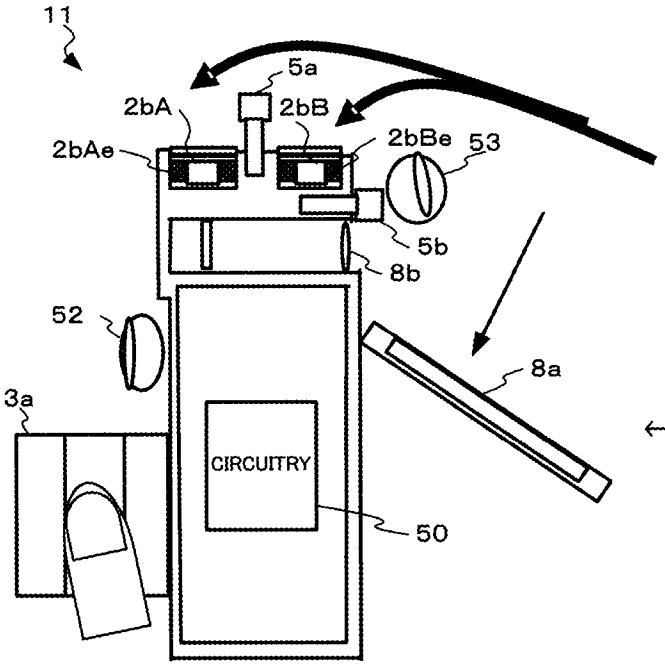

FIG. 5A and FIG. 5B are of an easily illustrated example, but in FIG. 5A and FIG. 5B also, similarly to FIG. 3, the first microphone 2*b*A and the second microphone 2*b*B are separated to the left and right by a stereo position difference Ds on a first surface and a second surface that are orthogonal to the optical axis O of the photographing lens 3*a*, looking from the front of the camera 11. Also, the first microphone 2*b*A and the second microphone 2*b*B are arranged apart by a directivity position difference Dd in the optical axis O direction of the photographing lens 3*a*.

FIG. 5A shows appearance of the user taking a movie, and FIG. 5B shows appearance of the user taking a still image. When shooting a movie, generally, as shown in FIG. 5A, the user grips the camera, and operates the movie button 5*b* while looking at the subject on the rear surface panel 8*a*. At this time, the user's forefinger 52 supports the front surface of the casing, and the thumb 53 operates the movie button 5*b*.

Also, when shooting a still image, generally, as shown in FIG. 5B, the user supports the rear surface of the casing with their thumb 53 while looking at the subject on the EVF 8*b*, and operates the release button 5*a* with their forefinger 52.

In this way, with the modified example of the microphone arrangement shown in FIG. 5A and FIG. 5B, the first microphone 2*b*A and the second microphone 2*b*B have a positional offset, and so function as a stereo microphone. Also, since the microphones are offset in the optical axis direction of the photographing lens 3*a*, it is possible to acquire voice data that has a phase difference in the front to rear direction of the camera. As was described previously, with the example shown in FIG. 5A and FIG. 5B the sound collection direction of the stereo microphone is directed in a direction that is substantially orthogonal to a direction that joins the user and a subject.

Figure 6:
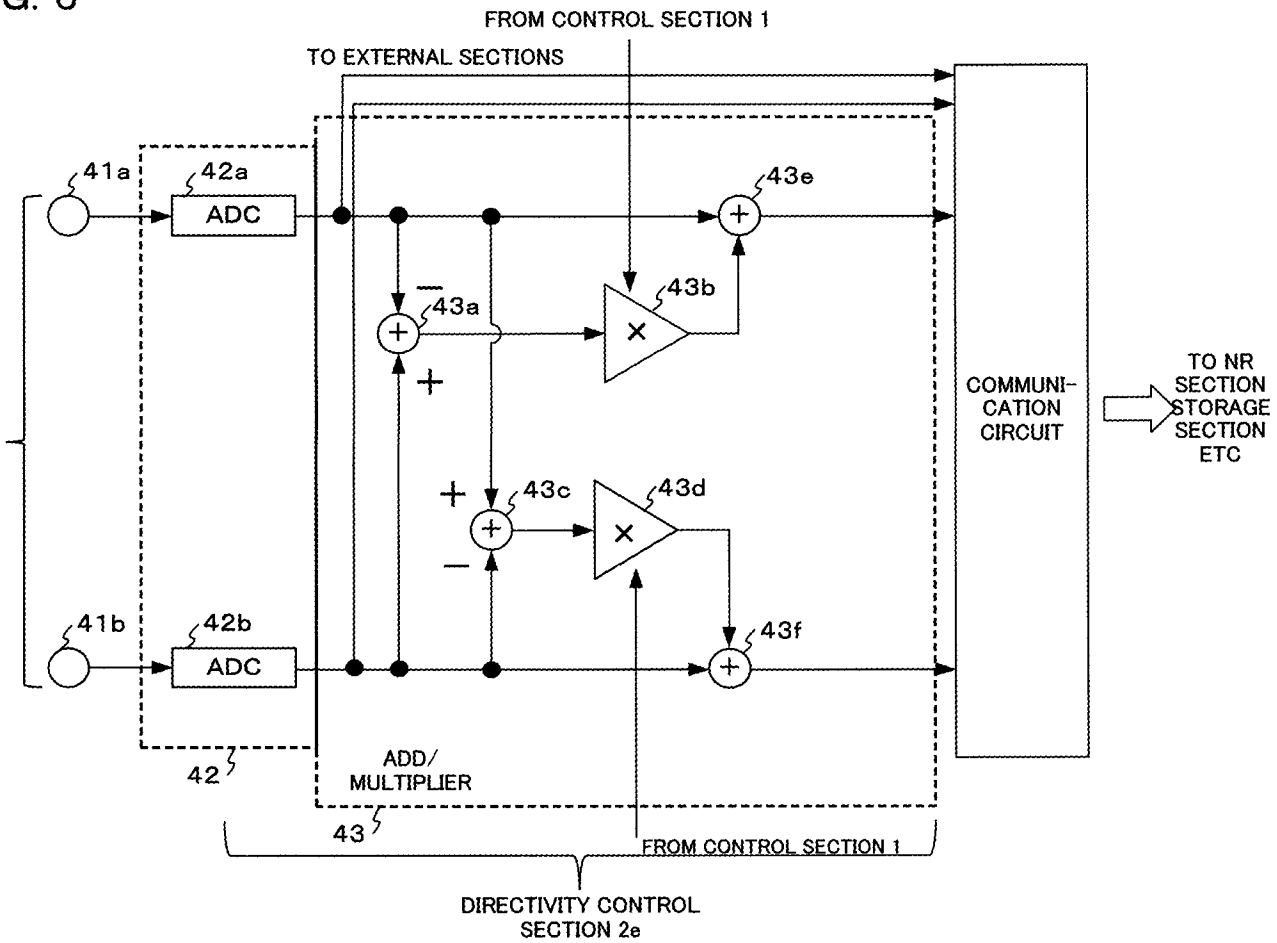
FIG. 6 is a block diagram showing a directivity control circuit in the sound collecting device of one embodiment of the present invention.

Next, the structure of the sound collection section 2 will be described using FIG. 6. The sound collection section 2 is provided with a plurality of microphones 2*b*, an A/D converter 42, and an adder/multiplier 43. The stereo microphone 2*b* comprises a main microphone 41*a* and a sub-microphone 41*b*, arranged at positions of the plurality of microphones as shown in FIG. 3 or FIG. 5A and FIG. 5B.

The main microphone 41*a* and the sub-microphone 41*b* are respectively connected to AD converters 42*a* and 42*b*, where speech signals are made into digital data. Specifically, the main microphone 41*a* is connected to the AD converter 42*a* while the sub-microphone 41*b* is connected to the AD converter 42*b*, and digital voice data is output. Output terminals of the AD converter 42 are connected to the adder/multiplier 43, and a difference between main and sub speech is calculated. Here, description will be given for two microphones, for simplification.

Specifically, the AD converter 42*a* that outputs voice data of the main microphone 41*a* is connected to a negative input terminal of an adder 43*a*, and to a positive input terminal of an adder 43*c*. Also, the AD converter 42*b* that outputs voice data of the sub-microphone 41*b* is connected to a positive input terminal of the adder 43*a*, and to a negative input terminal of the adder 43*c*.

Output of the adder 43*a* is connected to an input terminal of a multiplier 43*b*, and an output terminal of the adder 43*c* is connected to an input terminal of a multiplier 43*d*. Control terminals of the multiplier 43*b* and the multiplier 43*d* are connected to a signal processing and control section 1, to input gain for the multiplier 43*b* and the multiplier 43*d*. An input terminal of an adder 43*e* is connected to an output terminal of the AD converter 42*a* and an output terminal of the multiplier 43*b*. An input terminal of an adder 43*f* is connected to an output terminal of the AD converter 42*b* and an output terminal of the multiplier 43*d*.

An output terminal of the adder/multiplier 43 is connected to the storage section 26, which is an output section of the sound collection section 2. Specifically, an output terminal of the adder 43*e* and an output terminal of the adder 43*f* respectively output right side voice data and left side voice data, and respective voice data is output externally (to a storage section in the case of an IC recorder, communication section in the case of a microphone, etc.) by means of these output terminals. Output of the AD converters 42*a* and 42*b* can also be confirmed in external sections.

A part of the sound collection section 2 is constituted as previously described, and balance between a plurality of main and sub voice data from the microphones is controlled, and it is possible to change directivity of speech by narrowing or widening directivity. Speech signals that have been input using the two microphones 41*a* and 41*b* within the sound collection section 2 are converted to digital voice data by the AD converters 42*a* and 42*b*, (main microphone voice data)−(sub microphone voice data) is calculated by the adder 43*a*, and (sub microphone voice data)−(main microphone voice data) is calculated by the adder 43*c*. Specifically, a difference between main and sub voice data is calculated by the adders 43*a* and 43*c*. Here, a calculated difference is a difference between sounds of sub and main microphones that are arranged at different positions and hence transmission of the user's voice differs. For example, by reducing this difference, it is possible to emphasize sounds in a central position of the main and sub microphones, and this addition processing is preprocessing for this emphasis.

A difference obtained by the adders 43*a* and 43*c* is multiplied in respective multipliers 43*b* and 43*d* based on a gain from the signal processing a control section 1, and the result of this determination is respectively added to main microphone voice data and sub microphone voice data in the adders 43*e* and 43*f*. It should be noted that outputs of the adders 43*a* and 43*c* are negative, and so in actual fact subtraction is performed. This means that left and right voice data that is output from the adders 43*e* and 43*f* constitutes speech output with suppressed left and right sound spread. Here, if gain of the adders 43*b* and 43*d* is made large it is possible to neutralize level of sound expansion, while if gain is made small it is possible to broaden spread sensitivity. The control section 1 can change spread sensitivity by controlling gain for the adders 43*b* and 43*d* at the time of step S9, which will be described later.

In this way, with this embodiment it is possible to widen or narrow range of sound collecting using a pair of microphones of the same performance. In the case of wide directivity it is possible to sufficiently take in environmental sounds with a rich atmosphere, while in the case of narrow directivity it is possible to change direction of directivity by emphasizing a difference between microphones to store speech that has been focused in a specified direction.

Figure 7A:
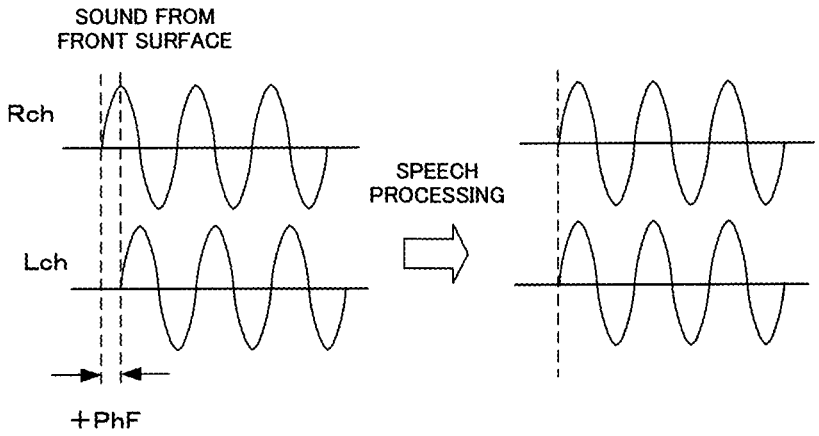
FIG. 7A and FIG. 7B are drawings for describing phase correction in a phase difference correction circuit of the sound collecting device of the one embodiment of the present invention.
Figure 7B:
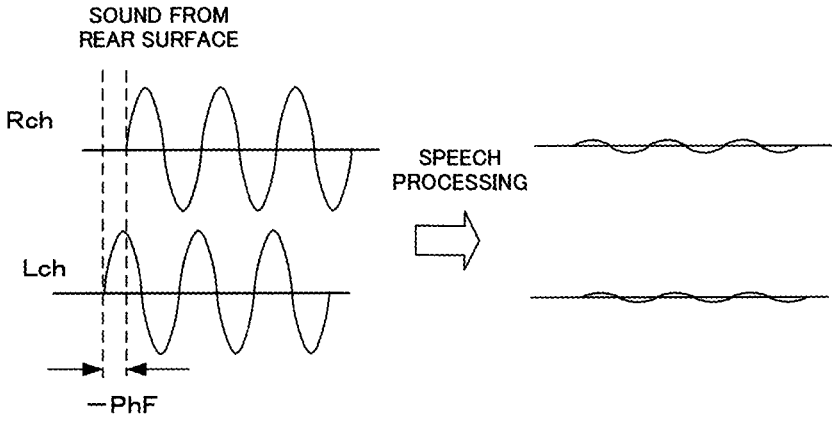

Next, phase difference correction in the phase difference correction section 1*d* will be described using FIG. 7A and FIG. 7B. The graph on the left side of FIG. 7A shows variation over time of speech signals resulting from conversion of speech that has come from a front surface by the right microphone (Rch) 2*b*R and the left microphone (Lch) 2*b*L, among the plurality of microphones 2*b*. As shown in FIG. 3, the right side microphone 2*b*R and the left side microphone 2*b*L are arranged providing a directivity position difference Dd in the optical axis O direction of the photographing lens 3*a*, in addition to a stereo position difference Ds. As a result, a phase difference (+PhF) occurs between the speech signals Rch and Lch.

Therefore, for speech that has come from the front, the phase difference (+PhF) is cancelled using the phase difference correction circuit, as shown by the graph on the right side of FIG. 7A, and speech processing is performed so as to keep the Rch speech signal and the Lch speech signal in step.

A phase difference (−PhF) also arises in two speech signals for speech that has come from behind. Speech that has come from the front is for a photographed object, and so is clearly stored, but on the other hand, speech that has come from behind is often not for a photographed object, and so it is preferable to make noise amount as small as possible. Therefore, attenuation processing is performed by the phase difference correction circuit, as shown by the graph on the right side of FIG. 7B. However, attenuation processing is not performed in a case where a user's voice command is confirmed.

It should be noted that absolute value of a phase difference of speech signals from the front and from the rear is PhF, put phase is reversed between the front and the back. This means that it is possible to detect direction of a sound source by looking at phase difference of the speech signals, and by controlling phase difference it becomes possible to extract only speech in a desired direction and in a desired sound collecting range. It is possible to reduce noise in a rear direction by attenuating speech from the rear direction.

Figure 8D:
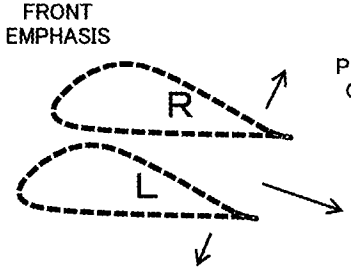

Next, usage states of the sound collecting device of this embodiment will be described using FIG. 8A to FIG. 8E. FIG. 8A shows a case where a movie of a scene that contains subjects that are spread out in front, such as an athletics meet, is being taken by the user using the camera 11. In this case, as was described using FIG. 5A, the user performs shooting while looking at the rear surface panel 8*a*, and stereo recording that emphasizes the spread of sound is performed using the plurality of microphones 2*b*. As the sound collecting ranges SAR and SAL, as shown in FIG. 8D, speech of the R channel and L channel to the front are emphasized, and peripheral noise is subdued as much as possible.

Figure 8E:
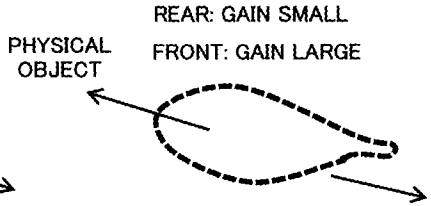

FIG. 8B Shows a case where the user is shooting a movie of a child while having a conversation with the child, using the camera 11. In this case also, the user performs shooting while looking at the rear surface panel 8*a*, but sound collecting range with the plurality of microphones 2*b* is different from the case of FIG. 8A. Specifically, only two directions, of the sound collecting range SAF of the person being spoken to (subject direction) and of sound collecting range SABa in the direction of the user, are made sound collecting ranges. In this case, since the user is close to the microphone while the person being spoken to is far away, sensitivities of the microphones are made different, as shown in FIG. 8E. Specifically, gain is made large for the sound collecting range SAF in the direction of the person being spoken to, while gain is made small for the sound collection range SABa in the direction of the user.

FIG. 8C shows appearance of the user shooting a still image of a physical object such as a bird, using the camera 11. In this case, as was described using FIG. 5B, the user determines subject composition and when to press the release button while looking at the EVF 8*b*. For speech input in the case of shooting a still image, emphasis is put more on command input for camera control at the time of still picture shooting, and a speech memo or the like at the time of shooting than on storing speech at a later date for speech playback. Also, it is often sufficient for a sound collecting range for speech to be a narrow range.

In this way, with this embodiment sound collection range differs in accordance with shooting conditions. This sound collection range is controlled by the directivity control section 2*e*. It is possible to reduce noise from a rear direction by attenuating speech from the rear.

Figure 10:
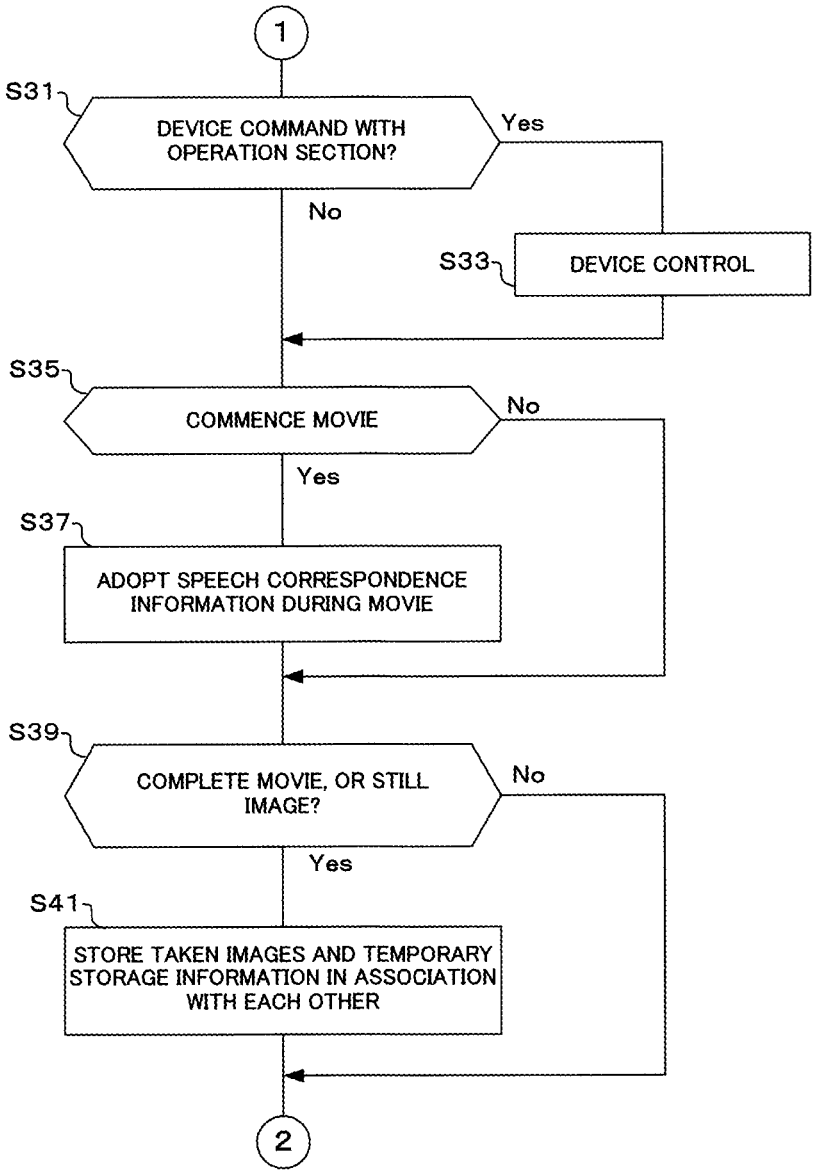
FIG. 10 is a flowchart showing operation of the sound collecting device of one embodiment of the present invention.

Next, operation of a camera having the sound collecting device of this embodiment will be described using the flowcharts shown in FIG. 9 and FIG. 10. This processing flow is executed by the CPU within the control section 1 controlling each section within the sound collecting device in accordance with programs stored in memory.

If the main flow shown in FIG. 9 is commenced, first determination of shooting conditions is performed (S1). Here, live view display is commenced. Live view display is displaying of a subject as a movie on the display section 8 based on image data that has been acquired by the imaging section 3. Determination of shooting conditions is also performed. This determination is determination of surrounding conditions, based on shooting mode that has been set in the camera and voice data that has been acquired by the plurality of microphones 2*b*. As shooting modes, they are shooting control modes such as program mode, shutter speed priority mode etc., and shooting modes for different scenes such as scenery mode, person mode etc.

If shooting conditions have been determined, it is next determined whether or not there is stereo recording (S3). Since the user operates the operation section 5 to set either stereo recording or monaural recording, in this step determination is in accordance with setting state by the operation section 5.

If the result of determination in step S3 is stereo recording, left right phase difference correction is performed (S5). The case of stereo recording is a case of shooting a movie that emphasizes sound spread, as was described using FIG. 8A. Also, a phase difference arises between the Rch and Lch, within speech coming from the front and from the rear, as was described using FIG. 7, because of the directivity phase difference Dd in the direction of the optical axis O of the photographing lens 3*a*. In this step, the phase difference correction section 1*d* performs correction of the phase difference.

Once the left right phase difference correction has been performed, it is stored temporarily as left and right channels (S7). Here, voice data that was subjected to phase difference correction is temporarily stored in the storage section 26, and will be actually stored later, so that playback is possible in synchronization with an image (refer to S41 in FIG. 10, which will be described later).

On the other hand, if the result of determination in step S3 is that there is not stereo recording, sound collecting direction switching and gain increase are performed (S9). As was described using FIG. 8B, this case is a case of shooting a movie while having a conversation, and sound collection ranges are narrowed to directions of the speaker and the photographer (user). Also, since the photographer is extremely close to the camera gain is made small compared to that of the speaker, and the speaker gain is made large. In this way the directivity control section 2*e* performs adjustment of sound collecting range (direction) and gain in accordance with shooting conditions.

Next it is determined whether or not speech determination is possible (S11). For voice data that has been acquired by the sound collection section 2 it is determined whether or not speech recognition is possible in the speech auxiliary control section 20, and it is possible to convert to characters. In the event that speech recognition is possible and it is possible to create characters, then it becomes possible to control the camera using speech (commands) that has been uttered into the camera by the user or the like, and to convert a conversation or the like to text and store.

If the result of determination in step S11 is that speech determination is not possible, warning display is performed (S13). Here, a warning that it is not possible to recognize speech is issued on the display section 8 or the like.

If warning display has been performed in step S13, or if the result of determination in step S11 is that speech determination is possible, characters are generated and display is performed (S15). In the event that speech is possible, the text generating section 25 can convert voice data to characters. In this step, therefore, voice data that has been acquired by the sound collection section 2 is converted to characters, and the characters that have been converted are displayed on the display section 8.

Next it is determined whether or not speech is a command for the device (S17). It is determined whether or not content of speech that was converted to characters in step S15 is a command for device control (S17). In a case where the device is a camera, as commands there are, for example, "zooming", "aperture value", "shutter speed value", "art filter", "still picture shooting", "commencement/completion of movie shooting" etc., and where the device is a recording device there are a "voice memo", "commencement/completion of recording", etc. In this step, it is determined whether or not speech is a command for the device by referencing the command dictionary 26*b* using text that has been acquired in step S15.

If the result of determination in step S17 is that the speech is a command for the device, device control is performed and a control history is temporarily stored (S19). Here, control of a unit that has been provided with the sound collecting device is performed based on a command for the unit that was detected in step S17. Also, what control was performed is temporarily stored in the storage section 26.

On the other hand, if the result of determination in step S17 is that the speech is not a command for the device, it is next determined whether or not the speech is a conversation (S25). Whether there are two or more speakers constituting a conversation is determined by determining characteristics of the voice data. It may also be taken as a basis on the determination whether or not the speakers are ones stored in the speaker recognition storage section 26*d*.

If the result of determination in step S21 is that it is not a conversation, the speech that is not recognized is temporarily stored as merely characters (S23). Here the speech is temporarily stored as a so-called monologue. The speech may also be treated as a voice memo.

On the other hand, if the result of determination in step S21 is a conversation, the speech is temporarily stored as a conversation (S25). The conversation can include situations such as a conversation between a parent and a child, as was described using FIG. 8B. Here, text that was converted in step S15 is temporarily stored as a conversation. In this case, if a speaker is stored in the speaker recognition storage section 26*d* it is possible to temporarily store text with the speaker specified.

If temporary storage of a stereo recording has been performed in step S7, or if temporary storage of a device control history has been performed in step S19, or if temporary storage merely as characters has been performed in step S23, or if temporary storage as a conversation has been performed in step S25, next device operation is performed by the operation section (S31). In the case of a camera as a device, it is determined whether various device operations have been performed, such as, for example, a zooming operation, still picture shooting, movie shooting, aperture value change, shutter speed value change, setting of art filter etc.

If the result of determination in step S31 is that there has been a device operation, device control is performed (S33). Here, control of the device is performed based on operating state that has been detected in the operation section 5.

If device control has been performed in step S33, or if the result of determination in step S31 is that a device operation was not performed with the operation section, it is next determined whether or not to commence movie shooting (S35). If the user commences movie shooting, the movie button within the operation section 5 will be operated. In this step determination is therefore based on whether or not the movie button has been operated.

If the result of determination in step S35 is to commence movie shooting, speech correspondence information during the movie is employed (S37). Even during shooting of a movie it is determined whether or not speech it is a command for device control, using the flow of control route step S39 No→S1 . . . S17→S19 . . . , or the flow of control route S39 Yes→S41 S39 No→S1 . . . S17→S19 . . . S1 . . . S17→S19 . . . . Therefore, if speech has been determined to be a command for device control, control of the device is performed in this step in accordance with the speech command.

If the processing of step S37 has been performed, or if the result of determination in step S35 is that movie shooting will not be commenced, it is determined whether to complete movie shooting or to perform still picture shooting (S39). In the case of completing movie shooting, the user may press the movie button again, and in the case of still picture shooting the user may operate the release button. In this step, it is determined whether or not these operations have been performed.

If the result of determination in step S39 is to complete movie shooting or perform still picture shooting, taken images and temporary storage information are stored in association with each other (S41). Here, the image file generating section 1*c* generates an image file (refer to FIG. 2) by associating image data of a movie or image data of a still image with information that was temporarily stored in steps S7, S19, S23, S25 etc.

If processing has been performed in step S41, or if the result of determination in step S39 was not movie completion and was not still picture shooting, processing returns to step S1 and the previously described processing is repeated.

Figure 11:
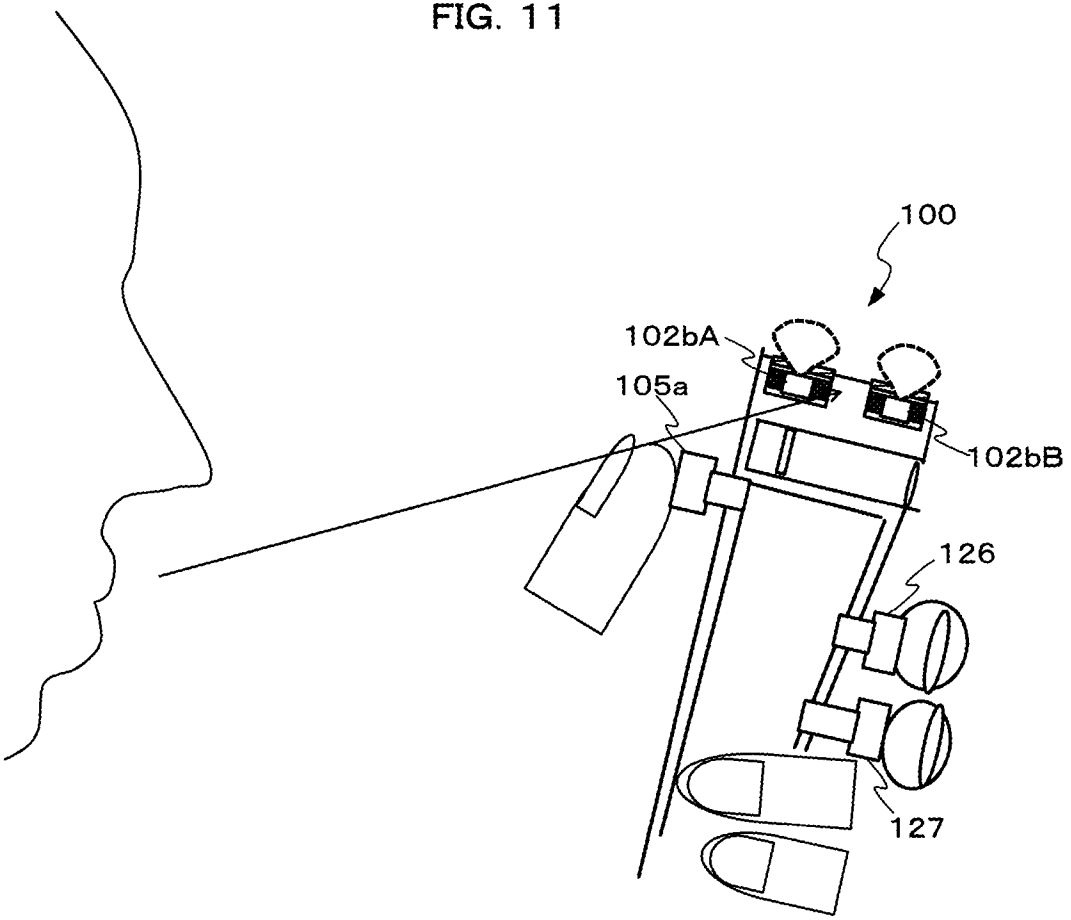
FIG. 11 is a drawing showing a usage state of a sound collecting device where the present invention is applied to an endoscope.

Next, an example where the present invention has been adopted in an endoscope 100 will be described using FIG. 11. Various operation members, such as a switch 126 for air supply and water supply operations, a switch 127 for suction operation, etc. are provided in the endoscope 100. Also, a release button 105*a* is provided at the near side to the operator, capable of operation together with an angle operation member for causing a bending section to curve.

A plurality of microphones 102*b*A, 102*b*B are arranged on an upper part of the endoscope 100, maintaining a range difference. A positional relationship between the operator and a patient is generally such that the patient is in a direction that joins the operator and the release button 105*a*. A plurality of microphones 102*b*A and 102*b*B are arranged at first and second surfaces that are orthogonal to the direction that joins the operator and the release button, a distance apart in the left right direction of the surfaces, and further the plurality of microphones 102*b*A and 102*b*B are arranged in front and behind in a direction connecting the operator and the release button. This means that the plurality of microphones 102*b*A and 102*b*B are arranged apart to the left and right, and in front of and behind, a line that joins the operator and the patient. It therefore becomes possible to appropriately control sound collecting direction and sound collecting range of speech based on phase difference between voice data from a plurality of microphones.

When observing using the endoscope 100 and storing image data, it is possible to store speech from the plurality of microphones 102*b*A and 102*b*B together. In this case, it is possible to optimally adjust sound collecting direction and sound collecting range for speech by employing the technology shown in FIG. 1 to FIG. 10. For example, in the case of taking still images of an affected part with an endoscope, sound collecting range may be switched in accordance with a case of talking to the patient while observing the affected part with the endoscope and a case of shooting the whole of an affected part as a movie.

As has been described above, with the one embodiment of the present invention, a plurality of microphones are arranged apart in a direction that joins a user and a subject and in a direction that intersects slightly obliquely, and also arranged at different distances in the direction that joins the user and a subject (refer to FIG. 3, FIG. 5A and FIG. 5B). Directivity for sound collecting is then adjusted in accordance with a phase difference between two speech signals from a stereo microphone (refer to S9 in FIG. 9 etc.). As a result it is possible to control directivity in accordance with state of a sound collection target. Also, if speech from a direction having a lot of noise is attenuated it is possible to reduce noise from a rear direction.

It should be noted that with the one embodiment of the present invention description has been given with an example of a camera or endoscope as a unit in which the sound collecting device is incorporated or that operates cooperatively with a sound collecting device. However, a unit in which a sound collecting device is incorporated or that operates cooperatively with a sound collecting device is not limited to these units.

Also, with the one embodiment of the present invention, an instrument for taking pictures has been described using a digital camera, but as a camera it is also possible to use a digital single lens reflex camera or a compact digital camera, or a camera for movie use such as a video camera, and further to have a camera that is incorporated into a mobile phone, a smartphone a mobile information terminal, personal computer (PC), tablet type computer, game console etc., or a camera for a scientific instrument such as a microscope, a camera for mounting on a vehicle, a surveillance camera etc.

Also, with the one embodiment of the present invention the specified speech extraction section 2*c*, compression section 4, attitude determination section 7, auxiliary control section 21, command determination section 23 and text generating section 25 have been constructed separately from the control section 1, but some or all of these sections may be constructed integrally with the control section 1. Also, although the image file creation section 1*c* and the phase difference correction section 1*d* have been provided within the control section 1, some or all of the sections may be constructed separately from the control section.

The image file creation section 1*c*, phase difference correction section 1*d*, specified speech extraction section 2*c*, compression section 4, attitude determination section 7, auxiliary control section 21, command determination section 23 and text generating section 25 are constructed using hardware circuits, but they may also have a hardware structure such as gate circuits that have been generated based on a programming language described using Verilog, and may also use a hardware structure that utilizes software, such as a DSP (Digital Signal Processor). Suitable combinations of these approaches may also be used.

Also, among the technology that has been described in this specification, with respect to control that has been described mainly using flowcharts, there are many instances where setting is possible using programs, and such programs may be held in a storage medium or storage section. The manner of storing the programs in the storage medium or storage section may be to store at the time of manufacture, or by using a distributed storage medium, or they be downloaded via the Internet.

Also, with the one embodiment of the present invention, operation of this embodiment was described using flowcharts, but procedures and order may be changed, some steps may be omitted, steps may be added, and further the specific processing content within each step may be altered. It is also possible to suitably combine structural elements from different embodiments.

Also, regarding the operation flow in the patent claims, the specification and the drawings, for the sake of convenience description has been given using words representing sequence, such as "first" and "next", but at places where it is not particularly described, this does not mean that implementation must be in this order.

As understood by those having ordinary skill in the art, as used in this application, 'section,' 'unit,' 'component,' 'element,' 'module,' 'device,' 'member,' 'mechanism,' 'apparatus,' 'machine,' or 'system' may be implemented as circuitry, such as integrated circuits, application specific circuits ("ASICs"), field programmable logic arrays ("FPLAs"), etc., and/or software implemented on a processor, such as a microprocessor.

The present invention is not limited to these embodiments, and structural elements may be modified in actual implementation within the scope of the gist of the embodiments. It is also possible form various inventions by suitably combining the plurality structural elements disclosed in the above described embodiments. For example, it is possible to omit some of the structural elements shown in the embodiments. It is also possible to suitably combine structural elements from different embodiments.

What is claimed is:

1. A sound collecting device, comprising:

an image sensor that subjects an image that has been formed by a lens to photoelectric conversion, and outputs an image signal;

stereo microphones arranged at a distance apart along a horizontal plane and in a direction obliquely intersecting an optical axis direction of the lens, the stereo microphones collecting sound from the same directional area, and further being arranged at different distances in the optical axis direction of the lens, and a processor for directivity control that adjust directivity of speech signals from the stereo microphones.

2. The sound collecting device of claim 1, further comprising:

an interface that sets a mode, wherein the processor switches to a first sound collecting characteristic that collects environment sounds and a second sound collecting characteristic that collects mainly sounds of a speaker, in accordance with the mode.

3. The sound collecting device of claim 2, wherein:

the first sound collecting characteristic is directivity towards a subject in front.

4. The sound collecting device of claim 2, wherein:

the first sound collecting characteristic is wide range stereo sound collection.

5. The sound collecting device of claim 1, wherein:

the processor adjusts directivity of speech from in front and from behind.

6. The sound collecting device of claim 1, wherein:

the processor is capable of a third sound collecting characteristic for collecting sound in a narrow range to the front.

7. The sound collecting device of claim 1, wherein:

the processor determines whether or not speech of the user that has been acquired using the stereo microphones is a command for device control, and if the result of determination is that the speech is a command, controls the sound collecting device in accordance with the command.

8. The sound collecting device of claim 1, wherein:

the stereo microphones have a first microphone that is arranged on a first surface that is substantially orthogonal to the optical axis direction of the lens, and a second microphone that is arranged on a second surface that is substantially orthogonal to the optical axis direction of the lens, and the first microphone and the second microphone are at different distances in the optical axis direction of the lens.

9. The sound collecting device of claim 1, wherein:

a sound collecting direction of the stereo microphones is directed in the optical axis direction of the lens, or is directed in a direction that is substantially orthogonal to the optical axis direction of the lens.

10. A sound collecting method, comprising:

providing a sound collecting device that comprises an image sensor that subjects an image that has been formed by lens to photoelectric conversion and outputs an image signal, and stereo microphones that are arranged apart along a horizontal plane and in a direction intersecting obliquely with respect to an optical axis direction of the lens, that collect sound from the same directional area, and that are arranged at different distances in the optical axis direction of the lens; and adjusting directivity of sound collection in response to phase difference of two speech signals from the two stereo microphones.

11. The sound collecting method of claim 10, wherein:

the sound collecting device has an interface for setting a mode, and further comprising switching to a first sound collecting characteristic that collects environment sounds and a second sound collecting characteristic that collects mainly sounds of a speaker, in accordance with the mode.

12. The sound collecting method of claim 11, wherein:

the first sound collecting characteristic is directivity towards a subject in front.

13. The sound collecting method of claim 11, wherein:

the first sound collecting characteristic is wide range stereo sound collection.

14. The sound collecting method of claim 10, further comprising:

adjusting directivity of speech from in front and from behind.

15. The sound collecting method of claim 11, further comprising:

switching to a third sound collecting characteristic for collecting sound in a narrow range to the front.

16. The sound collecting method of claim 10, further comprising:

determining whether or not speech of the user that has been acquired using the stereo microphones is a command for device control, and if the result of determination is that the speech is a command, controlling the sound collecting device in accordance with the command.

17. A sound collecting device, comprising:

an image sensor that subjects an image that has been formed by a lens to photoelectric conversion, and outputs an image signal;

a stereo microphone having a first microphone and a second microphone that convert speech from a user or subject into a speech signal, the first microphone and the second microphone being arranged at different distances in a direction substantially perpendicular to an optical axis direction of the lens, and further being arranged at different distances in the optical axis direction of the lens;

a phase difference detection circuit that detects phase difference between two speech signals that have been converted by the first microphone and the second microphone; and a processor for directivity control that adjusts directivity of speech signals based on the phase difference that has been detected by the phase difference detection circuit.

18. The sound collecting device of claim 17, wherein:

the directivity control processor, in the event that stereo recording is performed using a stereo microphone, performs left and right phase difference correction for speech signals from the first and second microphones based on the phase difference that has been detected by the phase difference detection circuit.

19. The sound collecting device of claim 17, wherein:

in a case where stereo recording using a stereo microphone is not performed, the directivity control processor performs switching of sound collecting direction or adjustment of sound collecting range from the first and second microphones.

* * * * *